US006691871B1

(12) United States Patent
Moeller

(10) Patent No.: US 6,691,871 B1
(45) Date of Patent: Feb. 17, 2004

(54) MESSAGE-BLANKET PACKAGE AND DELIVERY SYSTEM THEREOF

(76) Inventor: Elizabeth Moeller, 15010 Waybridge, Houston, TX (US) 77062

( * ) Notice: Subject to any disclaimer, the term of this patent is extended or adjusted under 35 U.S.C. 154(b) by 0 days.

(21) Appl. No.: 09/524,177

(22) Filed: Mar. 13, 2000

(51) Int. Cl.[7] ..... B65D 73/00
(52) U.S. Cl. ..... 206/484; 206/485
(58) Field of Search ..... 206/484, 484.2, 206/485

(56) References Cited

U.S. PATENT DOCUMENTS

| | | | | | |
|---|---|---|---|---|---|
| 4,949,415 | A | | 8/1990 | Selga | 5/502 |
| 5,133,496 | A | | 7/1992 | Davidson et al. | 229/92.8 |
| 5,158,499 | A | * | 10/1992 | Guckenberger | 206/484.2 |
| 5,396,987 | A | * | 3/1995 | Temple et al. | 206/484 |
| 5,442,567 | A | | 8/1995 | Small | 364/479 |
| 5,513,116 | A | | 4/1996 | Buckley et al. | 364/479 |
| 5,513,117 | A | | 4/1996 | Small | 364/479 |
| 5,615,123 | A | | 3/1997 | Davidson et al. | 364/479.03 |
| H1708 | H | | 2/1998 | Davidson et al. | 364/479.01 |
| 5,717,597 | A | | 2/1998 | Kara | 364/464.18 |
| 5,787,151 | A | | 7/1998 | Nakatsu et al. | 379/67 |
| 6,003,670 | A | * | 12/1999 | Beer | 206/484 |
| 6,085,904 | A | * | 7/2000 | Perdue, Jr. | 206/484 |
| 6,227,359 | B1 | * | 5/2001 | Truluck | 206/484 |
| 6,251,408 | B1 | * | 6/2001 | Dobler | 206/484 |
| 6,308,827 | B1 | * | 10/2001 | Hacikyan | 206/484 |
| 6,326,069 | B1 | * | 12/2001 | Barnett et al. | 206/484 |
| 6,338,407 | B2 | * | 1/2002 | Danville | 206/484 |
| 6,349,823 | B1 | * | 2/2002 | Innis | 206/484 |

* cited by examiner

*Primary Examiner*—Michael Cuff
*Assistant Examiner*—Bryan Jaketic
(74) *Attorney, Agent, or Firm*—Harrison Law Office

(57) ABSTRACT

A personalized message-blanket package enclosing a plurality of customer-selected tangible items for delivery to a plurality of recipients. In the preferred embodiment, the package comprises a blanket that completely covers its outer surface with the customer's message imprinted or otherwise impressed thereon. The present invention also provides a system and a method for generating such a message-blanket package by a customer interfacing with a personal computer that is connected to the Internet or to an intranet. By engaging with this interface, the customer gains interactive access to specially-designed software located on a host file-server in order to generate a customized multifaceted message consisting of a combination of pertinent verbiage, graphics images, clipart, and music. This customized message is physically imprinted upon the outer surface of the front and back panel of the message-blanket package. Then, the front and back panel are superimposed upon each other with corresponding outer edges aligned for being permanently bonded together. The generated message-blanket package is physically delivered to the recipient according to the prescribed tenor.

10 Claims, 17 Drawing Sheets

E
800
new customer
805
enter customer name & ID
855
enter customer information
810
A
retrieve customer information
845
select a previous package
850
A
820
retrieve selected package
825
create new record
830
store new record
835
transmit payment screen
842
C
840 customer information record customer request record

MESSAGE-BLANKET PACKAGE AND DELIVERY SYSTEM THEREOF

BACKGROUND OF THE INVENTION

The present invention relates generally to personalized gifts, greeting cards, or similar products. More specifically, the present invention relates to a personalized message-blanket package enclosing a gift or a tangible item, and a related Internet-based electronic system for generating and delivering such message-blanket package.

It is well known in the art that traditionally greeting cards are manufactured in large volumes with standard messages and card designs. These standard greeting cards are distributed to retail stores nationwide. Thus, a customer must physically go to the retail store to purchase a card and possibly a concomitant gift that properly communicate his or her feelings or intentions relevant to a particular recipient or event.

Once a greeting card or the like is purchased, it is placed in an appropriate envelope and mailed to the recipient. If this card is being included in a package with a gift, then the gift and card are appropriately wrapped and mailed or otherwise delivered to the recipient. This conventional delivery package is typically characterized by vanilla (brown paper) or gift wrap having only the address information imprinted on the exterior of the package. Alternatively, the card and gift may be placed in a suitably-sized cardboard box having only the address information imprinted on the exterior thereof.

Accordingly, package deliveries are cloaked or blanketed with standard paper or cardboard packaging material that is labeled with the sender and recipient's address and prerequisite postage or FEDEX or UPS codes or the like. Such conventional packaging material is devoid of any connection with the items enclosed within. Obviously, when a recipient receives a package—independently of its size or configuration—until the package is actually opened, there is no clue regarding its contents. As is well known in the art, unless a package is interesting to the recipient, either because of its form-factor or its source of origin, there is a strong likelihood that it won't ever be opened. That is, many deliveries are deemed to be "junk-mail" and are immediately trashed.

With the technology and on-line access rapidly permeating society at large, computer-driven systems have been developed for creating personalized greeting cards and the like. These personalized and customized greeting cards and the like may be designed to be delivered in a conventional physical format or may be designed to be delivered electronically via electronic mail ("e-mail") or by enclosing a link to a Web site upon which the electronic card is stored. Thus, the recipient may either enjoy the greeting card by simply opening an e-mail message or by clicking a link in an e-mail message and then be (logically, not physically) delivered to a Web site or the like.

Interactive access to these types of electronic systems may be provided by stand-alone kiosks, networked computer terminals, or Internet linked computer terminals. For example, in U.S. Pat. No. 5,513,116, Buckley et. al. disclose a stand-alone machine for vending greeting cards or other customized products. Audio presentation to customer of available products is also provided, along with associated design options, method of payment, and mode of delivery. Similarly, in U.S. Pat. No. 5,442,567, Small discloses a stand-alone kiosk computer for simultaneously dispensing personalized greeting cards and electronically vendable gifts. A credit card reader and cash receiving equipment are included for accepting customer payment. In U.S. Pat. No. 5,513,117, Small further discloses another stand-alone system for dispensing personalized greeting cards and gifts that incorporated an alternative embodiment for customers who are physically unable to visit vending retail establishments. In this instance, rather than compelling customers to visit a stand-alone kiosk, the customer may access the underlying computer system via a networked interactive computer terminal.

Another example of a computer processor-based system accessed via a networked terminal is taught by Cannon et. al. in U.S. Pat. No. 5,600,563. Social expression cards are printed using information stored in card description database linked to a plurality of selection categories. The database is then loaded on remote printing units via removable storage media. A user interacts with the printing units via menus to select a desired card image from a plurality of categories. After the desired card image is selected, the printing unit then retrieves the card description from the database and prints the selected card image. Similarly, in U.S. Pat. No. 5,600,563, Kara discloses a computer-based system that interacts with a customer to create individualized greeting cards and personalized stamp indicia, calculates the postage due for this greeting card, and prints labels.

As it is well known by those skilled in the art, the Internet is now commonly accessed at home as well as at work. Many commercially available software products have been designed in anticipation of on-line access from personal computers by adults and children enjoying the comforts of being home. Accordingly, a plethora of electronic or computer-driven systems have been developed to enable users to first create and then to purchase personalized and customized products. For example, in U.S. Pat. No. 5,692,132, Hogan discloses a system in which a user with a personal computer may interact with merchant computers via the Internet to conduct cashless credit card transactions for the purchase of small items. Similarly, in U.S. Pat. No. 5,870,718, Spector discloses a computer linked to the Internet that is adapted to produce a composite greeting and gift certificate card that is authorized by a retailer. A user selectively downloads the greeting card and gift certificate software into a local personal computer.

In spite of these and related developments in the art, there appears to be no apparatus or method that contemplates the creation and delivery of a package that externally contains a greeting and/or a personalized message, with or without associated objects or things contained within the package. It should be evident to those skilled in the art that greetings that arrive in card-form or otherwise, and gifts and the like, are normally packaged with plain wrapping paper material or with decorative wrapping paper material. Other than such package known in the art possibly having an occasion-specific or holiday-specific decoration imprinted on the wrapping materials, the recipient must physically open the package in order to receive the intended message. For instance, to the extent that wrapping paper shows a graphic image of a baby rattle or teddy bear, the recipient will surmise that the package contains a baby gift therein. Similarly, if a package arrives with a Christmas-flavored wrapping paper, then the recipient will anticipate a Christmas card and present being contained therein. However, there is unknown in the art a package that is received with a substantive message or the like imprinted or otherwise affixed to the exterior of the package. The present invention provides an apparatus and mechanism whereby a package is generated with a plurality of customized messages blanketing the package; hence, such message is instantaneously and automatically read by the recipient upon his or her taking possession of the package.

Accordingly, these limitations and disadvantages of the prior art are overcome with the present invention, and improved means and techniques are provided which are useful for generating a message-blanket package that assures the delivery of substantive messages and concomitant items or the like either in a commercial or social or political environment.

SUMMARY OF THE INVENTION

The present invention provides an apparatus that is configured with a customized or personalized message or with a plurality of customized or personalized messages disposed upon the exterior of a package that encloses a plurality of tangible items, e.g., gifts, small objects, candy, and the like. Thus, it is contemplated by this aspect of the present invention, that a plurality of messages essentially comprising a blanket are imprinted upon, affixed to, or generally disposed upon a package for delivery to the designated recipient. In the preferred embodiment, this message-package covers the outer package surface of a package that typically has a "pudgy" appearance due to the presence of a plurality of objects contained therein.

It will be appreciated that the preferred embodiment of the present invention does not suffer from the infirmity of the prior art wherein packages arriving from unknown origins or with unclear purposes or perhaps presumed to constitute junkmail, are immediately discarded. On the contrary, upon delivery of the message-blanket package of the present invention, the recipient is instantaneously and inherently exposed to the sender's message. It will be understood by those skilled in the art, that a package that arrives with the message-blanket taught by the present invention tends to increase the likelihood achieving the intended behavioral impact and effect because the recipient routinely will be unable to avoid reading the plurality of messages that are integrated externally of the package being delivered.

In another aspect of the present invention, there is contemplated a computer system that enables a customer to use a personal computer or the like to link to the Internet, to a network, or the like for interactively design a complete message-blanket package. Implicitly invoking and interfacing with a specially-designed computer system preferably located on a host file-server, a user or customer may create a simulated image of a package inherently blanketed with a plurality of customized messages. It will, of course, be readily understood that the messages contemplated by the present invention may consist of a combination of verbiage, graphics, clipart, pictures, music, etc. As will be hereinafter described, the pudgy package taught by the present invention is, in addition to creating a plurality of suitable messages that are disposed on the exterior surface of the package, there is a plurality of tangible items selected for enclosure within the package. Indeed, inclusion of such items and the like is what affords the message-blanket package its pudgy or swell appearance. After the design for the message-blanket is finalized, it is physically generated and then delivered to the recipient or recipients according to the prescribed tenor, i.e., via regular mail, Federal Express, United Parcel Service, etc.

In another aspect of the present invention, once the customer has completely defined the message-blanket package of the present invention, the associated user and message-blanket package information is stored in a plurality of databases accessible at a plurality of suitable file-servers. Using these stored customer records in conjunction with a concomitant database containing a rich and diverse selection of message attributes, the present invention envisions a construction phase for creating, first, an emulated on-screen message-blanket package, followed by the generation of the actual physical message-blanket package. Thus, as appropriate database records are retrieved and interpreted by corresponding configuration and construction software modules, the codes and parameters specifying the physical configuration of the message-blanket package are used to logically build the specified package and then, pending user-approval of the emulated package, to physically build the message-blanket package from suitable materials including paper, cloth, plastic, or the like. The specified shape of the front and preferably congruent back panels of the package are then cut from the stock material, corresponding edges thereof aligned and configured into the message-blanket package, and then permanently bonded together around the encased selected plurality of items. In a manner well known in the art, the physical message-blanket package may also be laminated with protective film or the like to assure safe delivery and to prolong the aesthetic appearance of the delivered package.

It is an object of the present invention to provide an apparatus constituting a personalized and customized message-blanket package that inherently assures the delivery of a plurality of messages simultaneously upon physical delivery of the package.

It is an object of the present invention to provide an apparatus constituting a personalized and customized message-blanket package that imparts a plurality of messages to a recipient upon physical delivery of the package and prior to the recipient opening the package.

It is another object of the present invention to provide an apparatus constituting a personalized and customized message-blanket package that affords a stuffed or pudgy appearance due to the presence of a plurality of physical objects contained within the package.

It is an object of the present invention to provide a computer system for generating a personalized message-blanket package tailored to meet a user or customer's specifications.

It is yet another object of the present invention to provide a network-based computer system enabling a user or customer to remotely generate a customized message-blanket package.

It is still another object of the present invention to provide a computer system enabling the generation of customized message-blanket packages consisting of a plurality of elements including graphics, text, clipart, music, etc.

It is another object of the present invention to provide a computer system for customizing and generating a selected message-blanket suitable for diverse commercial, personal, or political requirements.

Other objects and advantages of this invention will become apparent from the following description taken in conjunction with accompanying drawings wherein are set forth, by way of illustration and example, certain embodiments of the present invention.

IN THE DRAWINGS

FIGS. 9A–E illustrate the rendition of possible screen selection displays utilized by the present invention to generate a customized message-blanket package.

Figure 10A:
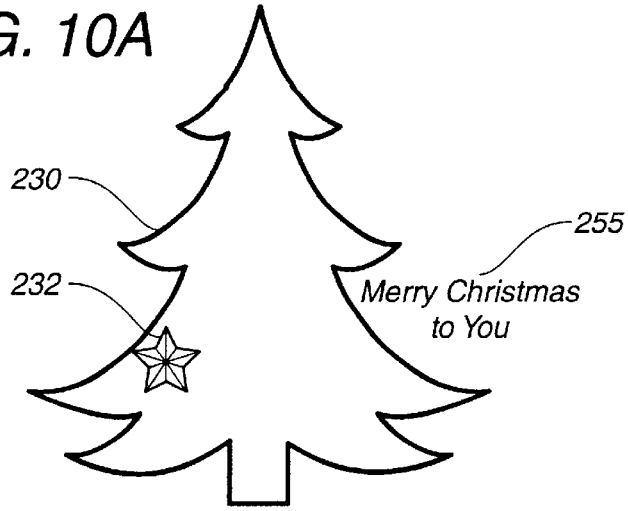

FIG. 10A illustrates a specific embodiment of a generated graphics image for the front and back covers of the package.

Figure 10B:
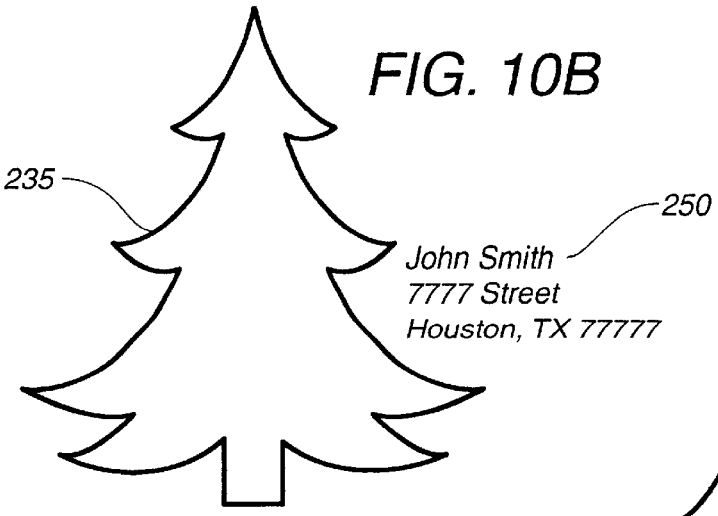

FIG. 10B illustrates a specific embodiment of a generated graphics image for the back cover of the package.

Figure 10C:
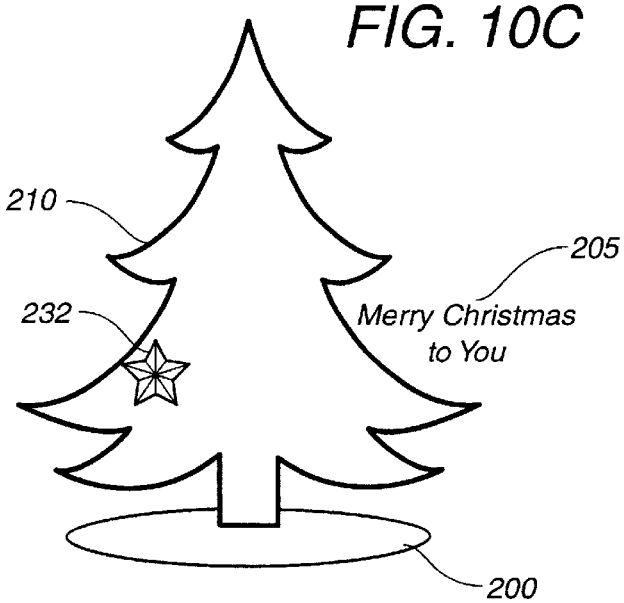

FIG. 10C illustrates a specific embodiment of a completed message-blanket package showing the opening at the bottom of the package for filling the selected gift.

FIGS. 11A–F are flow charts of the process by which the customer request personalized packages.

Figure 12A:
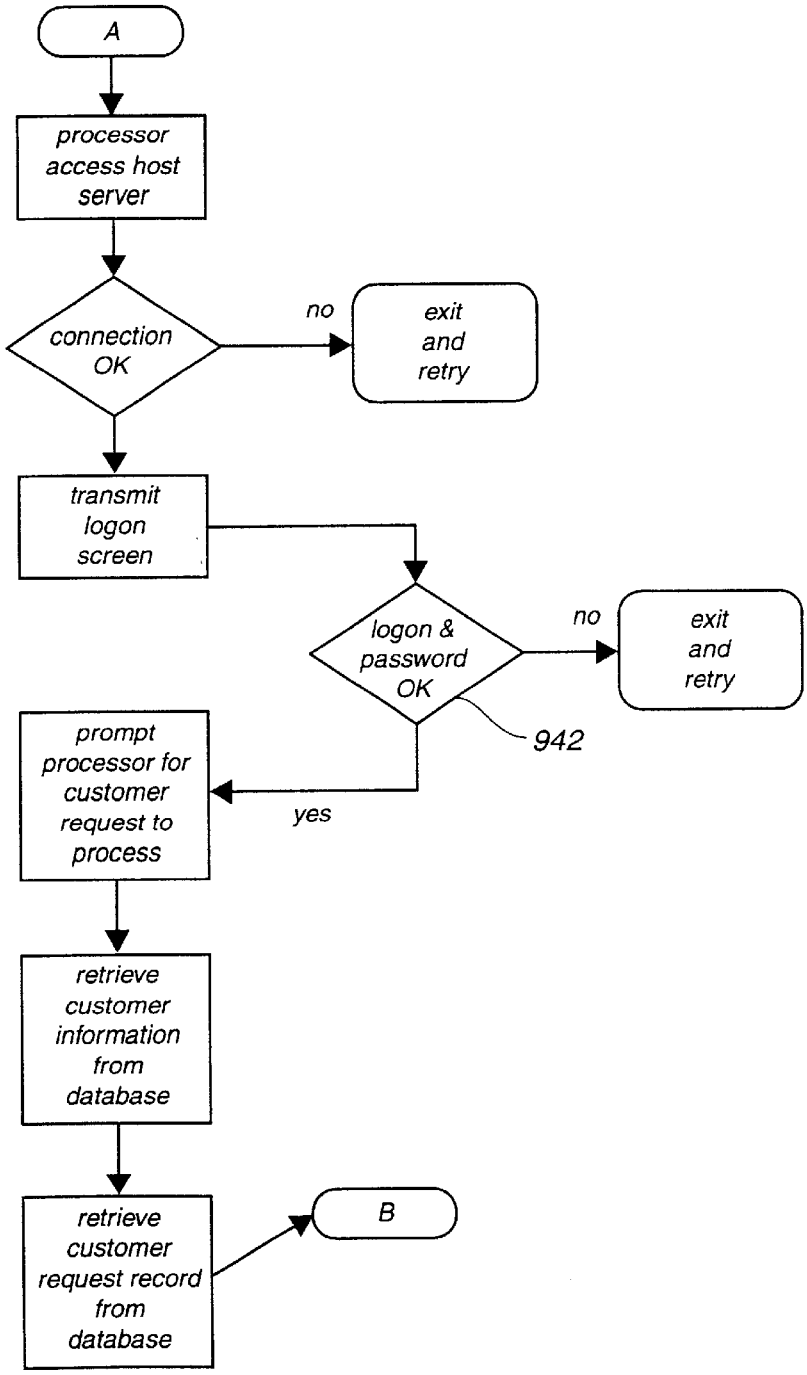
Figure 12B:
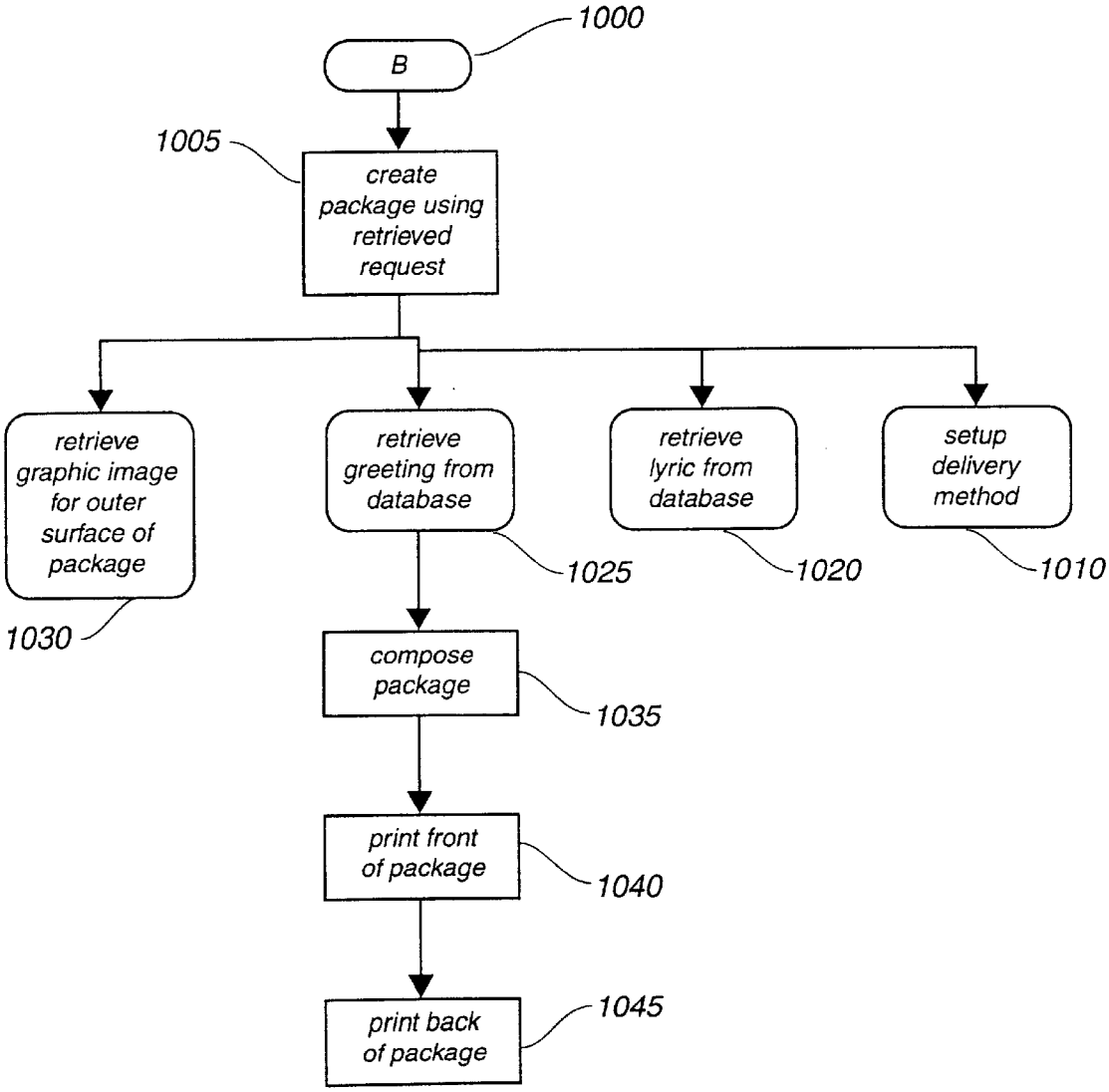

FIGS. 12A–B are flowcharts of the process by which the final package is generated from the customer request.

Figure 12C:
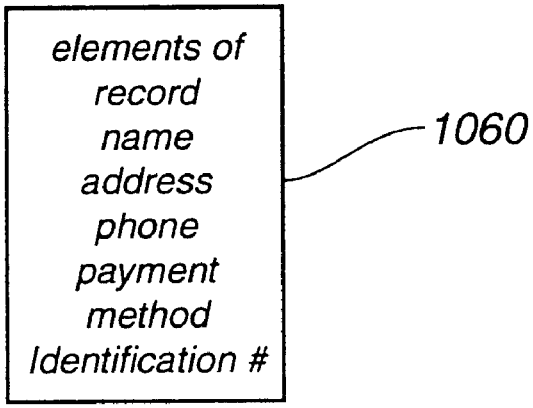
Figure 12C:
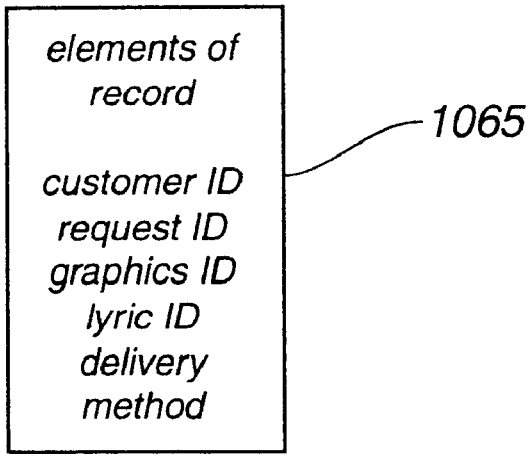

FIG. 12C is a representative layout of the customers' database record utilized by the present invention.

Figure 13:
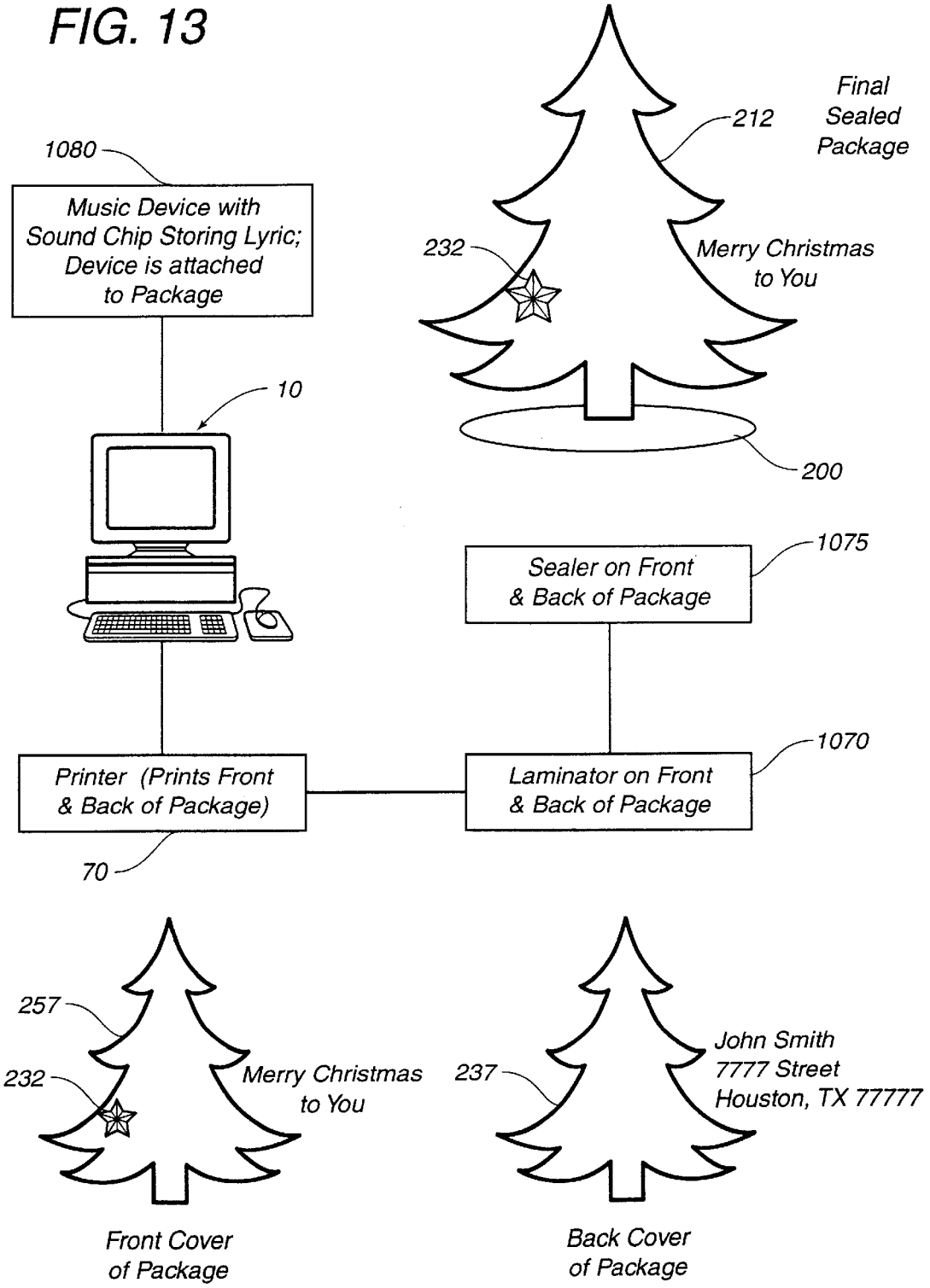

FIG. 13 is a block schematic diagram of how the final package of this invention is printed, laminated, and then physically bonded together for delivery to the recipient.

DETAILED DESCRIPTION

The present invention teaches an apparatus for enabling the simultaneous delivery of a combination of a message and a package wherein the recipient is automatically exposed to the message upon taking physical possession of the package. As will be hereinafter described, the message-blanket of the present invention assures that the recipient will actually read the message simultaneously with the delivery of the associated package.

It will be understood that the present invention provides an apparatus and system for generating a message-blanket that inherently enables the simultaneous delivery of a specific, customized message and a concomitant package to an intended recipient or group of recipients without such recipient or recipients being compelled to open the package in order to read the message. As will become apparent to those skilled in the art, it is an inherent feature of the present invention that a message is delivered by being imprinted upon or integrated with the exterior of a package. Hence, a message is essentially logically delivered when a recipient takes physical possession of the package. Since the package is essentially blanketed with the message, the step of physically opening the package is extraneous to the delivery of the primary message. It will be apparent to those skilled in the art, however, that the package must be physically opened in order for the recipient to ascertain the internal contents. Since the packaging inherent in the present invention typically comprises a congruent bonded pair of (front and rear) panels, the plurality of tangible items encased therein tends to impart a laden or "pudgy" appearance thereto.

Figure 1:
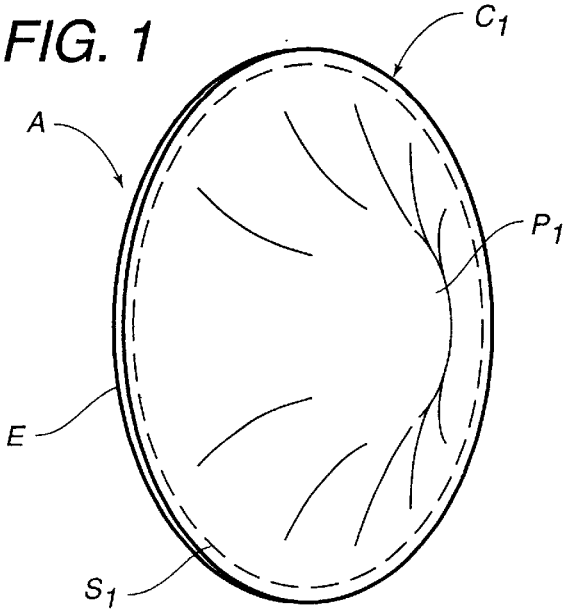
FIG. 1 is a frontal perspective view of a preferred embodiment of the message-blanket package of the present invention, in the absence of a message disposed upon the exterior thereof.

Now referring collectively to FIGS. 1–6, there is seen the pudgy message-blanket apparatus A that simultaneously delivers plurality of messages $M_1$ and $M_2$, and plurality of tangible items T contemplated by the preferred embodiment of the present invention. Referring specifically to FIG. 1, there is depicted a frontal perspective view of message-blanket apparatus A that focuses upon the swell or pudgy configuration thereof caused by the presence of a plurality of tangible items T (shown in FIG. 6). Thus, top or external surface $C_1$ of message-blanket A is depicted with pudgy section $P_1$ and edge E.

Figure 2:
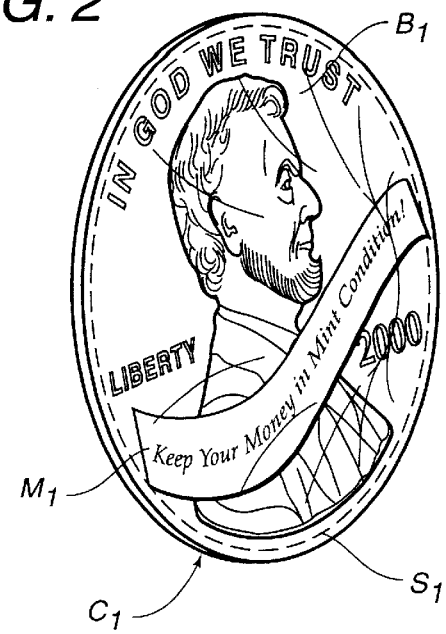
FIG. 2 is a frontal perspective view of a preferred embodiment of the message-blanket package of the present invention.
Figure 3:
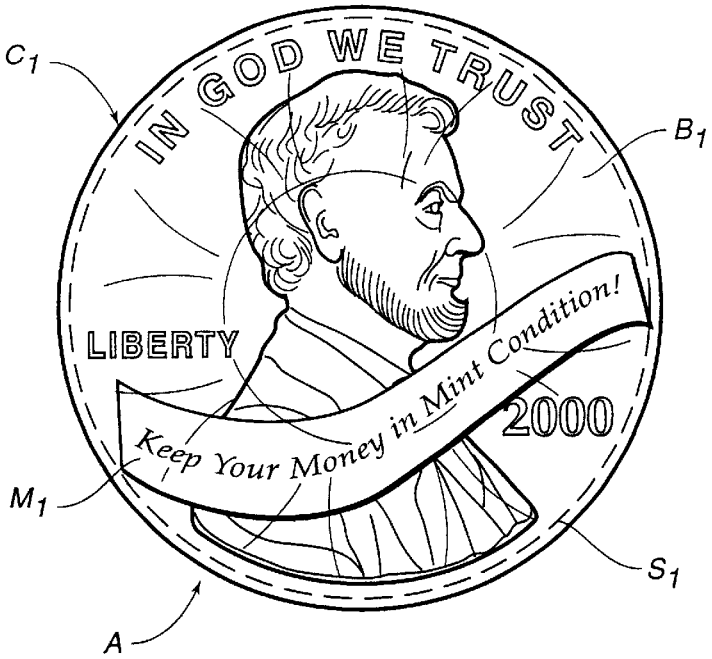
FIG. 3 is a front view of the embodiment of the message-blanket package of the present invention depicted in FIG. 2.
Figure 5:
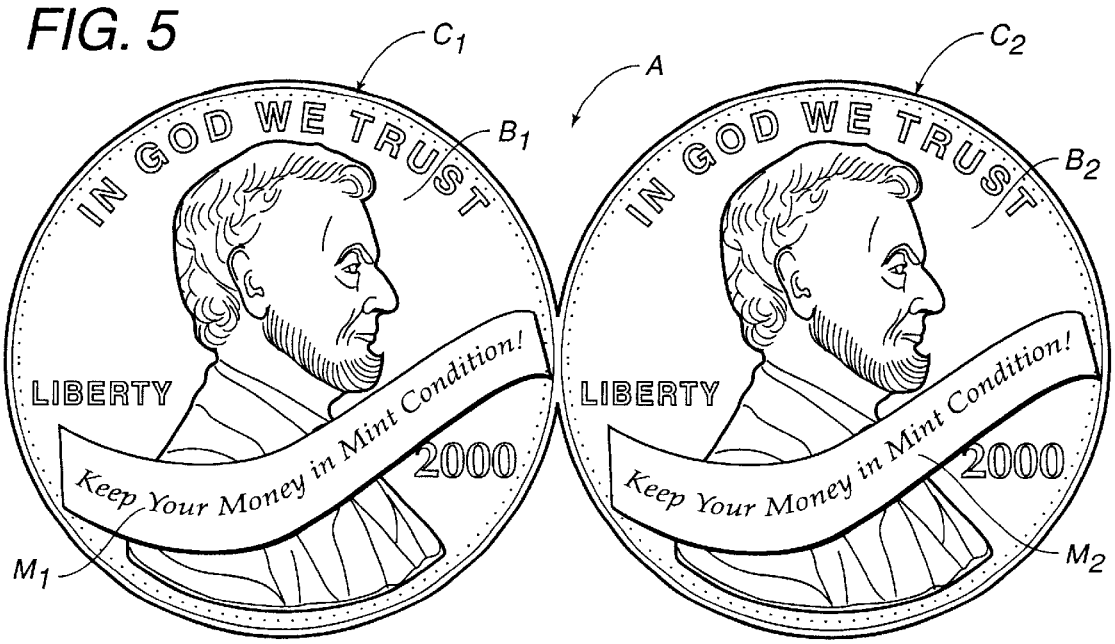
FIG. 5 is a front view of the embodiment of the message-blanket package of the present invention depicted in FIGS. 2–4, with the exterior of the front and back portions disposed in an open position.

Referring now to FIGS. 2, 3 and 5, there is shown the plurality of messages delivered by message-blanket A. More particularly, message M1 is clearly seen imprinted upon exterior cover surface $C_1$ relative to background $B_1$. It should be evident to those skilled in the art that the illustration shown communicates message $M_1$ as "Keep Your Money in Mint Condition" upon thematic background $B_1$ corresponding to an easily-recognized emulation of conventional currency including the familiar slogan "IN GOD WE TRUST." Ergo, the particular plurality of messages $M_1$ and $M_2$ being conveyed by message-blanket A may be accentuated or reinforced by judicious selection of concomitant corresponding plurality of backgrounds B, and $B_2$, respectively. It will be readily understood that, while in FIG. 5 message $M_1$, disposed upon surface $S_1$ of cover $C_1$ and $M_2$ disposed upon surface $S_2$ of cover $C_2$, are identical, two different messages may be disposed thereupon. Of course, it would be preferable for maximizing the likelihood of communicating the intended marketing, social, or political message to the plurality of recipients that $M_1$ and $M_2$ be designed to reinforce each other. Similarly, depending upon the logical connection between messages $M_1$ and $M_2$, corresponding backgrounds $B_1$ and $B_2$ should be appropriately selected.

Figure 4:
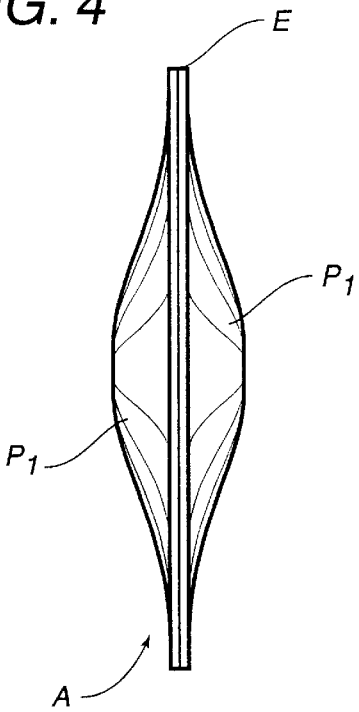
FIG. 4 is a side view of the embodiment of the message-blanket package of the present invention depicted in FIG. 2.
Figure 6:
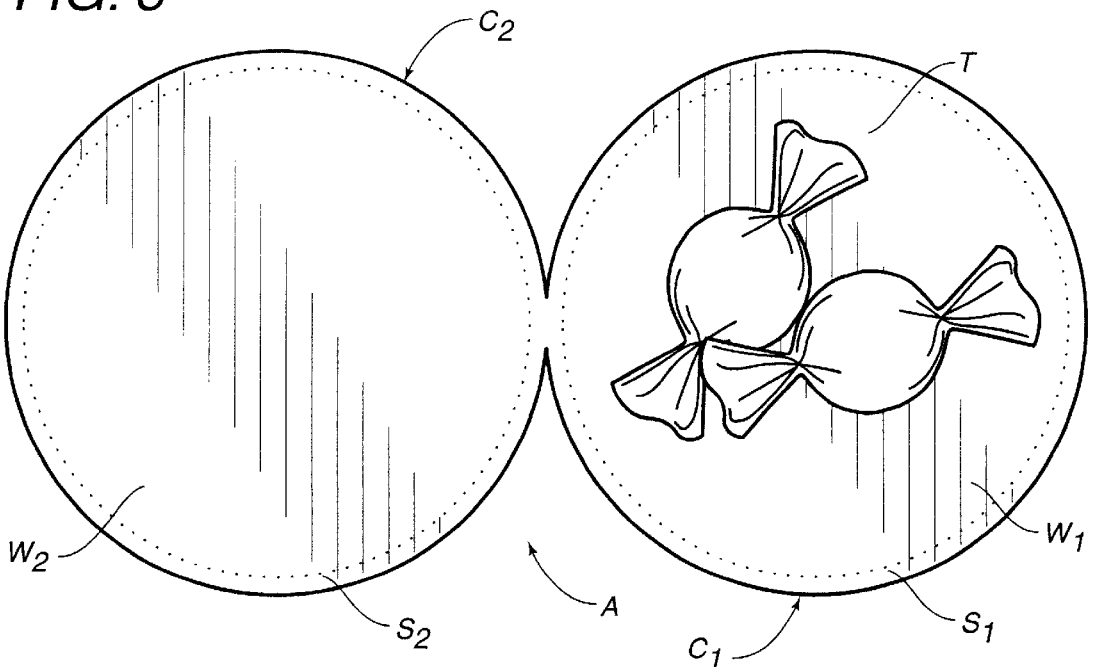
FIG. 6 is a front view of the embodiment of the message-blanket package of the present invention depicted in FIGS. 2–4, with the interior of the front and back portions disposed in an open position, and also depicting a plurality of items that are contained within.

Now referring specifically to FIGS. 4 and 6, there is shown a frontal view of the interior surface or wall $W_1$ and $W_2$ of message-blanket covers $C_1$ and $C_2$. While each of these interior walls are preferably uncluttered and simply reflective of the material of construction, it is within the teachings of the present invention that messages in some suitable format may be affixed thereon. Securing means $S_1$ and $S_2$ fixedly attach the continuous peripheral edges of cover $C_1$ to the like edges of cover $C_2$. Also shown is plurality of items T that are contemplated to be contained within pudgy message-blanket A. It should also be understood by those skilled in the art that, while covers $C_1$ and $C_2$ are depicted as being essentially congruent, the relative configuration of each may be somewhat. Any offset or disparity between the configurations of each of $C_1$ and $C_2$ will tend to accentuate the bulkiness or pudginess $P_1$ and $P_2$ of message-blanket A. Covers $C_1$ and $C_2$ are disposed in a parallel relationship and fixedly attached by securing means $S_1$ and $S_2$; edge E is formed therebetween. It will also be appreciated, however, that if the disparity between the configuration of $C_1$ and $C_2$ is too great, then it may be difficult to adequately secure the respective peripheral edges with stitching $S_1$ and $S_2$ of any other conventional securing means such as glue, Velcro, etc.

Figure 7:
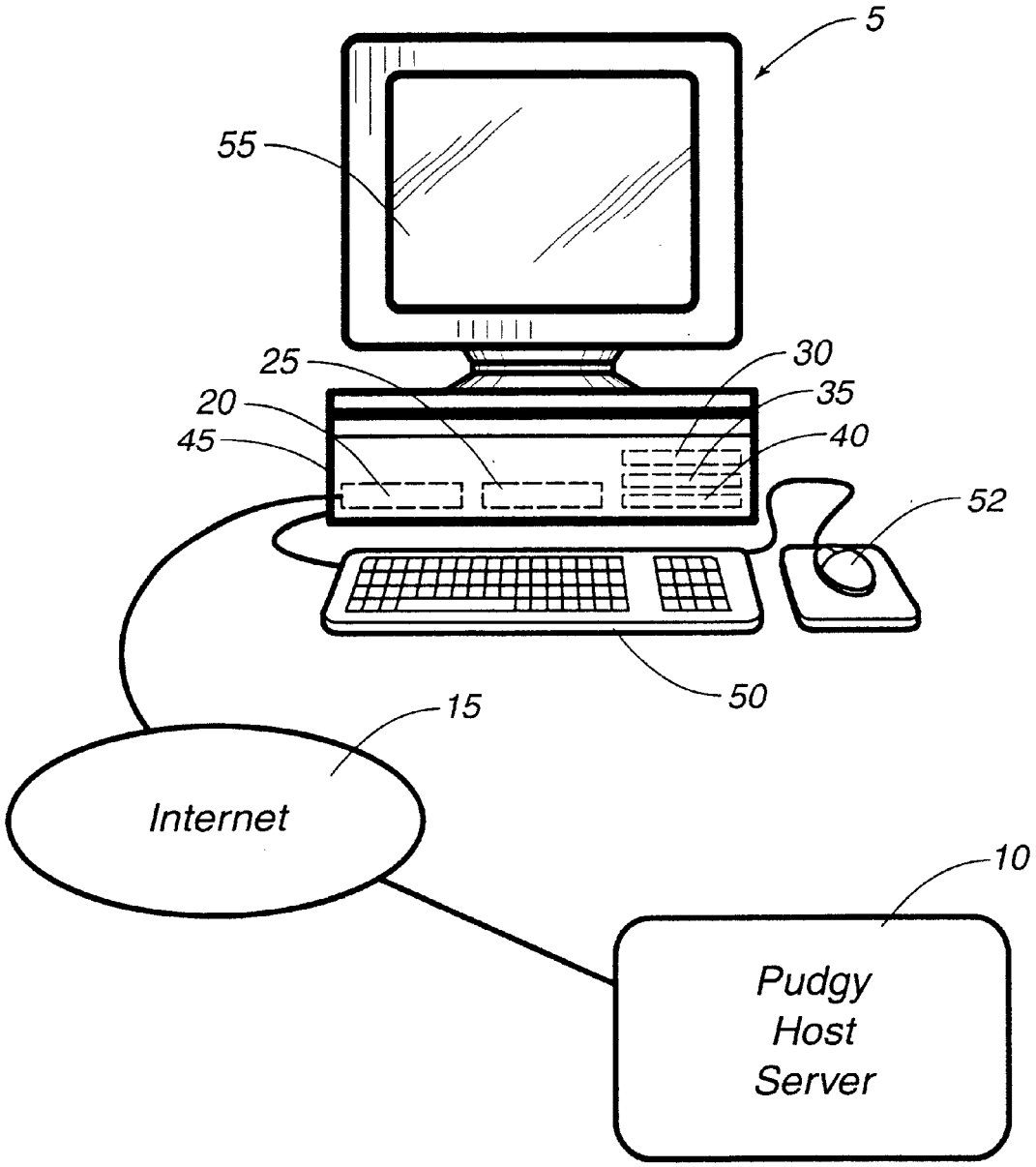
FIG. 7 is a block schematic diagram of a customer's personal computer in accordance with the present invention linked to the Internet.
Figure 8:
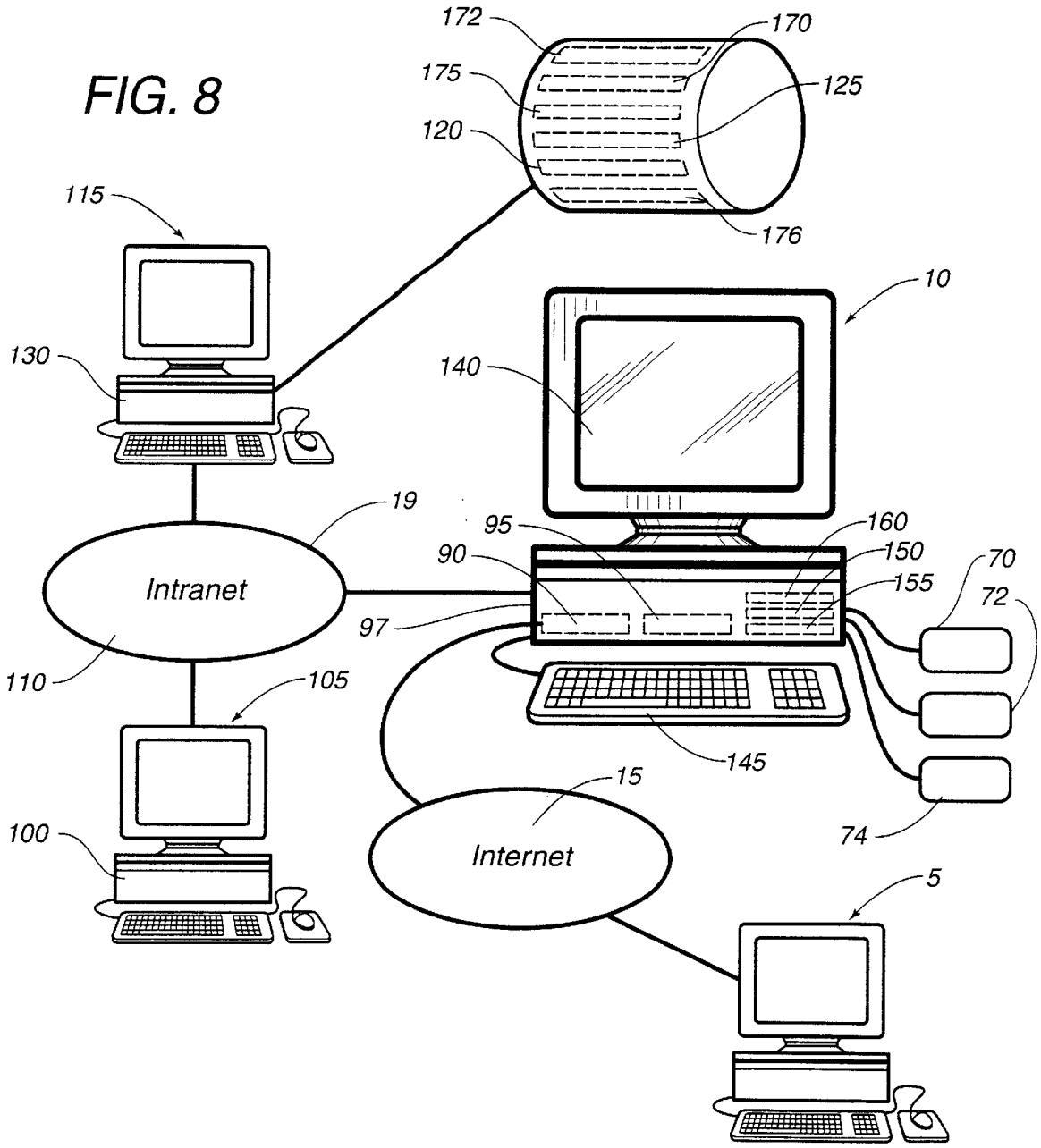
FIG. 8 is a block schematic diagram of the host server computer in accordance with the present invention linked to the Internet.

As will be hereinafter described in detail, the present invention provides a methodology for generating a customized package means designed to deliver a particular message externally of the package means and contents related to the message contained internally thereof. Now referring to FIG. 7 there is shown a simplified sketch of a plurality of devices prerequisite for generating the message-blanket package of the preferred embodiment of the present invention. Thus, there is seen the system of the preferred embodiment comprising one of a plurality of user's personal computers 5 interconnected with message-blanket server 10 via Internet 15. Referring specifically to FIG. 8, there is depicted message-blanket server using plurality of databases 165 to service customer requests for generating packages with message-blankets as will be hereinafter described in detail.

It should be appreciated by those skilled in the art that network 15 contemplated by the present invention includes not only the Internet, but also may consist of a corporate intranet or the like, a wide area network ("WAN"), a local area network ("LAN"), or any other suitable ensemble of interconnected file servers that may provide the services and functions as herein described. In a manner well known in the art, each digital computer 5 is used by a customer to access network 15 via a conventional modem 20, cable connection, or the like. Of course, to achieve reasonable response times contemplated by the preferred embodiment, modem 20 should afford a transmission speed of at least 56K and should preferably comprise a digital or ADSL (asynchronous digital service line) capabilities. Thus, the connection at a particular computer location may be initiated via an ad hoc dial-up or may be a permanent link typically provided by ADSL. It should be obvious that any form of transmission of information may be used to effectuate embodiments of the present invention. For instance, networks contemplated by the present invention may be effectuated using methodologies that include radio, infrared, microwave, satellite, cellular communications, and any other forms of wireless communications. It should be appreciated by those skilled in the art that an even faster connection of computer 5 to network 15 may be attained if a user has access to high-speed trunk lines such as a T1 or T3 line.

In the present invention, for customers to access software 150 of the preferred embodiment, a preassigned URL is invoked activating host file-server 10. In a manner well known in the art, host file-server 10 is assigned a corresponding IP address with software 150 being stored thereon. It should be evident to those skilled in the art that host server 10 corresponds to the HTTP server computer with digital computer 5 corresponding to the client or user computer. Typically, a user interacts with software 150 by reading the content presented on the Web site using browser 40 or the like.

Hence, by invoking a plurality of functions and options presented by the preferred embodiment on the appropriate Web page, a user may request that particular services contemplated by the present invention be performed that, in turn, generate a novel message-blanket package. In FIG. 7, a typical hardware configuration of digital computer 5 includes, inter alia, random access memory (RAM) 25 for storing currently executing modules or the like of software 150, central processing unit (CPU) 45 for executing the modules stored in RAM 25, monitor 55 for displaying multimedia information output by software 150, and input devices comprising mouse 52 and keyboard 50 for effectuating the interaction of a user with software 150 stored on hard drive 30. As hereinbefore described, user computer 5 affords the capability of transmitting and receiving data over communications infrastructure, i.e., via land or under water lines or wireless, constituting the Internet via HTTP or the like using browser software 40 or the like. Browser 40 interprets the underlying HTML code or the like and then presents it to the user as a formatted, readily readable multimedia graphical user interface manifest on one or more Web pages.

Now, again referring specifically to FIG. 8, host file-server 10 is depicted similarly to digital computer 5, having conventional hardware components RAM 95, CPU 97, keyboard 145, and modem 90. This embodiment shows host server 10 interconnected to both Internet 15 and intranet 19. An intranet as contemplated herein is a privately owned, secure commercial network affording limited access to authorized personnel. Thus, corporate users would have secure password-access or the like to the present invention via intranet 19 while individual users would have general access thereto via the Web at large. In either scenario, of course, full access to the functions and features of the present invention would be the order of the day. Thus, as shown, host server 10 is interconnected with plurality of digital computers 105 and 115 of LAN 110.

The software used by the present invention to generate a message-blanket package comprises customization software 150—for creating and storing message configuration data—and construction software 155 for generating the physical embodiment corresponding to the user-specified package. Referring now to FIGS. 5A–E, there is depicted the preferred process of generating a message-blanket package based upon customer requests. First, of course, as shown in block 505, customer typically initiates execution of browser software 40 by effectuating prerequisite mouse 52 and keyboard 50 actions. By invoking browser 40, it is loaded into RAM 25 and executed by CPU 45. Then, Internet browser 40 establishes an Internet connection either as a dial-up using a conventional analog or digital modem 20 or using an essentially permanent connection using cable a modem or the like. Establishing this connection with Internet 15 at step 565, the customer may readily access the Home Page by specifying the appropriate URL or domain name that points to the Web site driven by software 150 of file-server 10. Assuming that there is no obstacle to a user venturing beyond the Home Page, e.g., a user not having or remembering a password prerequisite on an intranet, a screen is presented for interfacing with customization software 150. In a manner well known in the art, except during periods of maintenance downtime or the like, software 150 is loaded into RAM 95 for execution continuously by CPU 97 of file-server 10. Thus, the preferred embodiment is designed for a plurality of geographically dispersed customers to access software 150 by remote access enabled at each of a plurality of digital computers 5.

Figure 11A:
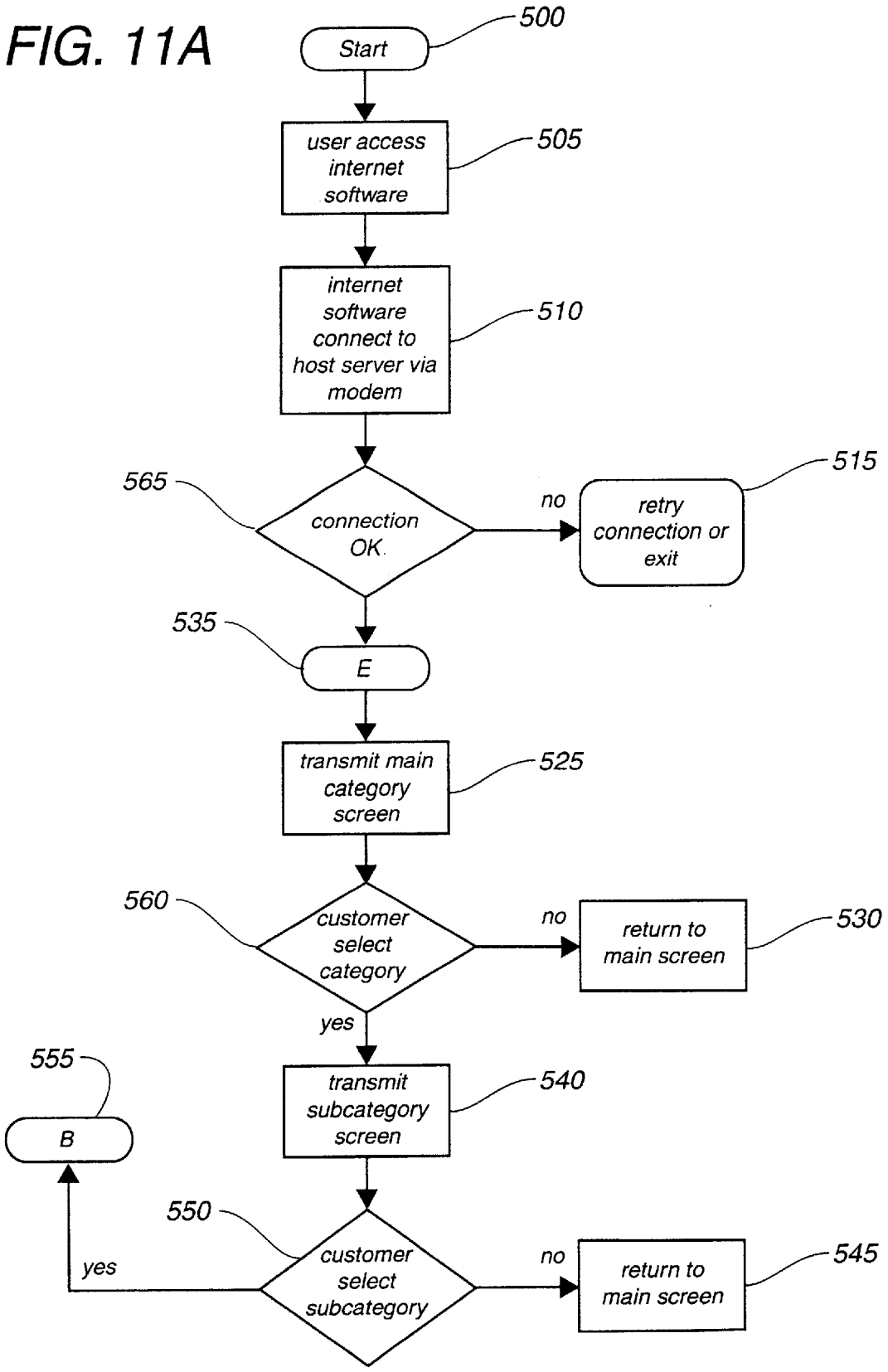

It will be readily understood that, after a user enters the online multimedia domain taught by the present invention, the user is prompted to enter pertinent information. Generally, a user may be simply entertaining making an order but actually just seeking a sampling opportunity. Alternatively, a user may have already made an order and is seeking to ascertain the status of delivery. Alternatively, a user may be seeking to specify an order for the creation and delivery of a plurality of message-blankets. FIG. 11E depicts a flow chart illustrating the modus operandi for acceptance of pertinent customer information. First, it is ascertained whether the user is an existing customer. If the user is an existing customer, software 150 automatically retrieves pertinent customer information at step 845, and transmits back to the customer at step 850 the Web page affording an option to use an existing message configuration or profile stored in customer database 176. If the customer opts to use an existing profile, the process steps associated with creating a customized message-blanket package, hereinafter described, are omitted.

Hence, having the benefit of a pre-existing profile, at process step 825, the customer is prompted via an appropriate Web page displayed on the customer's monitor 55 to enter previous package configuration data. After this package configuration is entered, at process step 830, customization software 150 retrieves the pertinent data from customer database 176 and generates a new customer request record (including the retrieved configuration data). Next, software 150 stores the new request record in customer database 176 for subsequent processing by construction software 155.

Figure 9A:
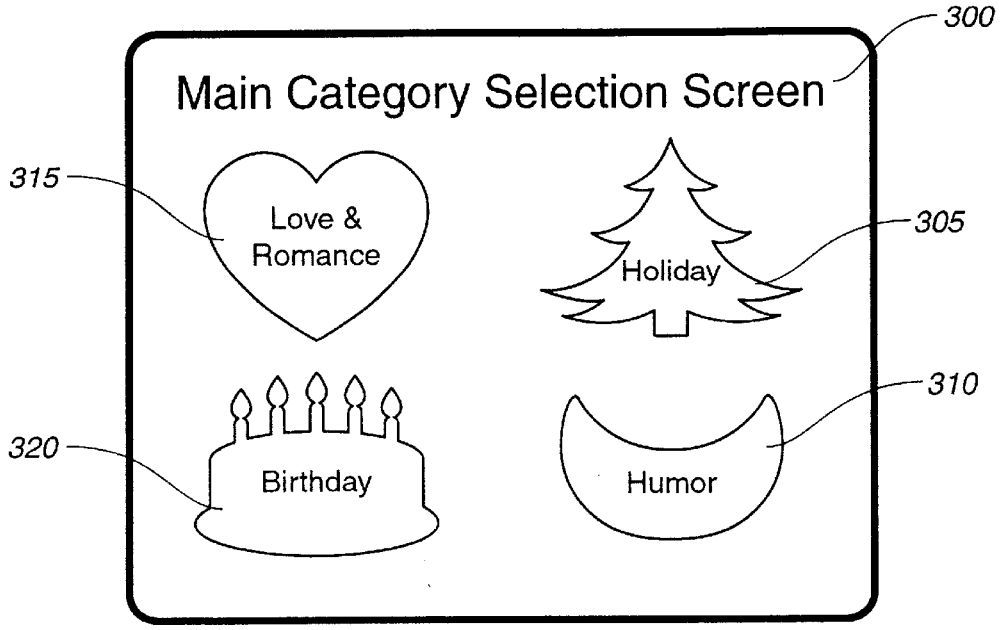
Figure 9B:
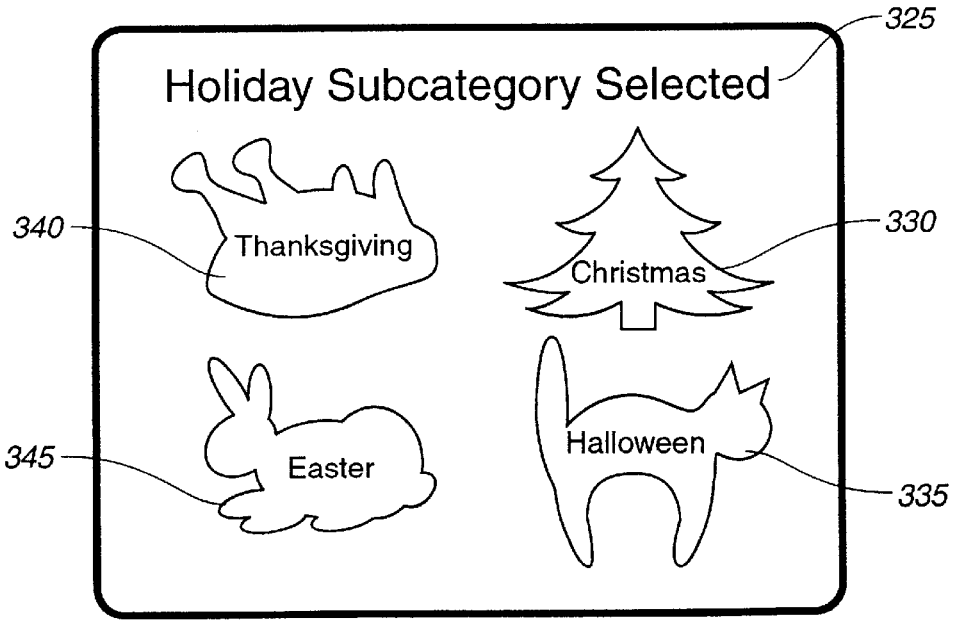

On the other hand, if customization software 150 determines that the user is a new customer or if an existing customer opts out of using an existing profile, the customer then is presumed to intend to create a new configuration corresponding to a new message-blanket package. Referring specifically to FIG. 11A, to facilitate the creation of a particular message-blanket configuration, occasion menu Web pages are preferably downloaded and contemporaneously presented to the customer on computer 5. These occasion menus preferably consist of a main category displayed on a Web page and concomitant subcategory Web pages ordered within selected categories. Accordingly, in process step 525, the category Web page is downloaded from file-server 10 to user computer under the control of customization software 150. The customer selects, at step 560, the appropriate category and, by association, the underlying hypertext link, in process step 550, the corresponding subcategory Web page. For illustrative purposes, FIGS. 9A and 9B depict examples of representative occasion menu Web pages. Thus, FIG. 9A displays a sample category Web page depicting possible occasions. After the customer selects the holiday category, and implicitly selects the holiday category hypertext link, the holiday subcategories depicted in FIG. 9B are displayed. Of course, occasions may also include particular events and topics. Thus, it is within the concept of the present invention to generate custom message-blanket packages for such events as opening of a new restaurant and attendance at a political fund-raiser, and for special solicitations including a new release of a software application and special time-limited sale of a particular brand of clothing.

Figure 11B:
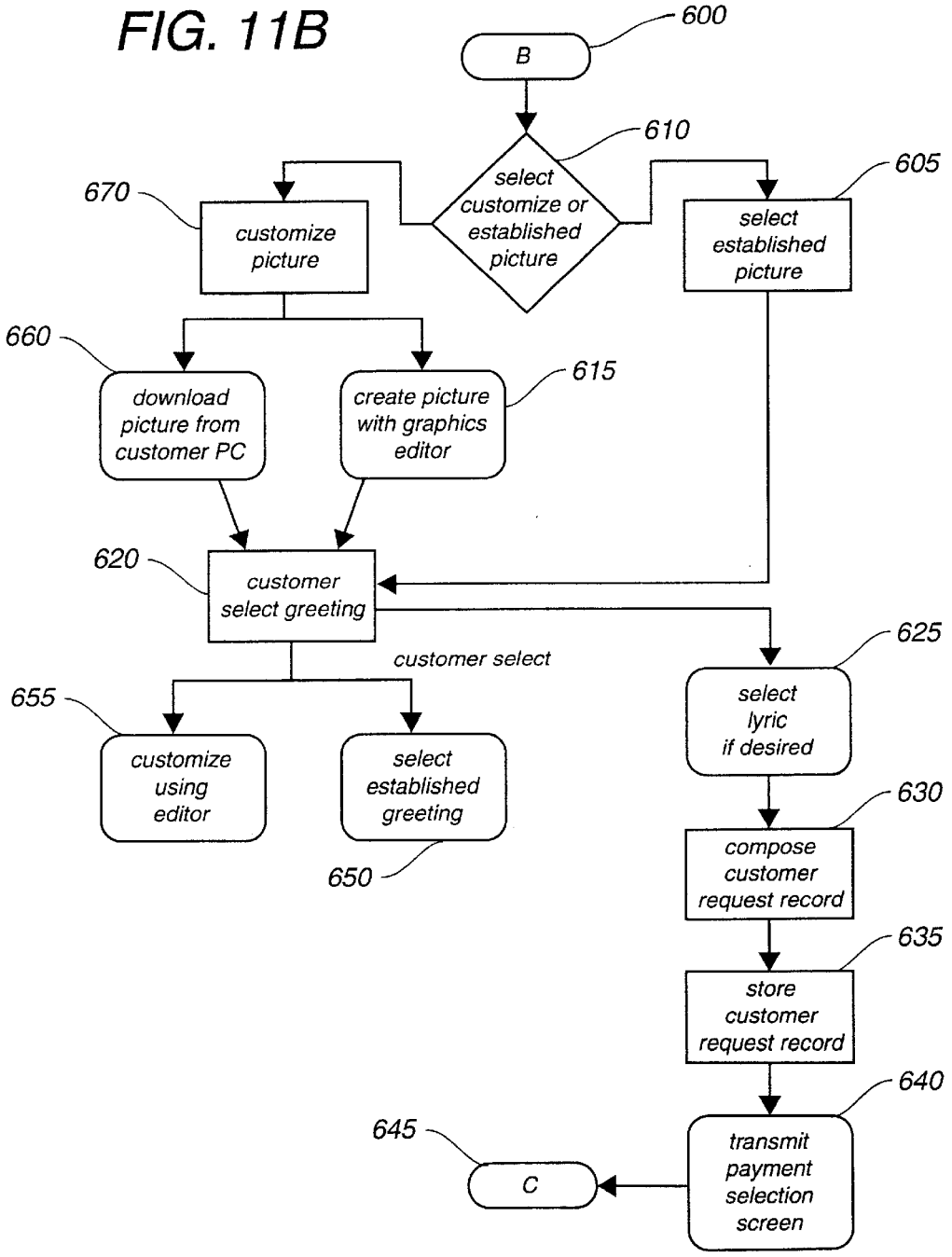

Once the customer selects the desired categories/subcategories depicted in FIGS. 9A and 9B, the customization software of the present invention then proceeds to the generation of message-blanket configuration data as illustrated in FIG. 11B. At process step 610, the customer is prompted to either to select an established picture from graphics image database 175, at step 605, or to create a customized picture, at step 670. After picture-selection is completed, in step 620, the customer is prompted to either proceed to step 650 to select an established greeting from greeting image database 125 or to step 655 to create a customized greeting. Then, sequentially, the customer is prompted, at step 652, to select items for enclosure in the message-blanket package; then, at step 653, to select a suitable stock for physical package generation; and then, at step 625, to select, if desired, a lyric for incorporation into the written message displayed on the exterior of the generated package. After the customer completely specified the intended message-blanket package customization, customization software 150 generates a plurality of corresponding customer request database records for subsequent processing by related construction software 155.

Figure 9C:
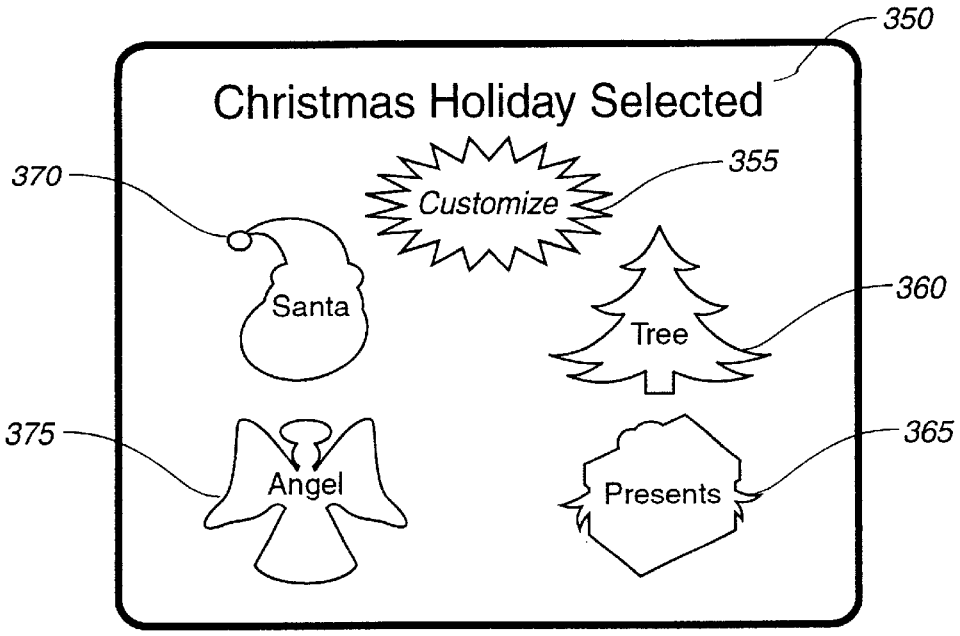
Figure 9D:
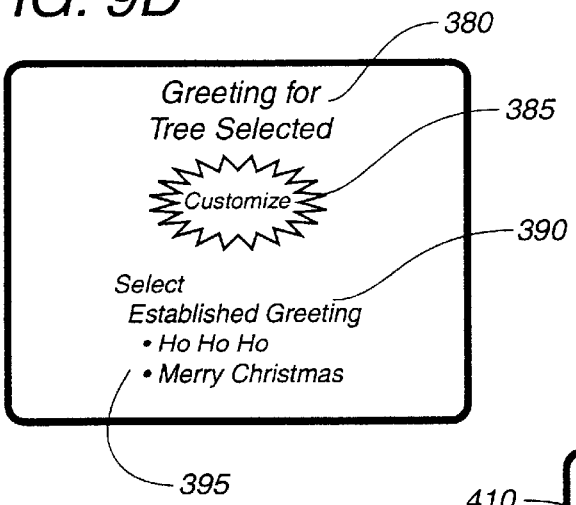
Figure 9E:
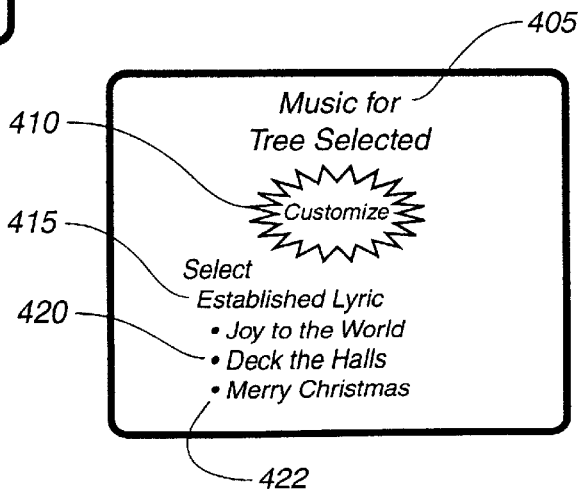

To illustrate the Web pages contemplated by the present invention, FIGS. 9B–3D depict sample Web pages for selection of an established picture, greeting, and lyric, respectively. Thus, the Web page illustrated in FIG. 9B, depicts the holiday subcategory "Christmas" corresponding to the selection of hypertext link 330. Based upon the selection of link means 330, the customer is prompted, as depicted in FIG. 9C, to select a graphic image presumably appropriate for the Christmas theme. This theoretical selection is manifest in FIG. 9C, wherein a tree image is selected, corresponding to hypertext link 360. After the tree image has been selected, the customer is prompted, as depicted in FIG. 9D, to select a suitable greeting. As shown therein, greeting 395, "MERRY CHRISTMAS TO YOU" has been selected. Then, the customer is prompted, as shown in FIG. 9E, to select a suitable lyric. As shown therein, lyric 422, "Wish You a Merry Xmas," has been selected. After the customer has completed this stepwise selection methodology, customization software 150 associates each selected aspect of the message-blanket configuration data with an identification code means or other parametric means for inclusion in the database for subsequent processing by construction software 155 to ultimately produce the user-specified package contemplated hereunder.

Following this message-blanket definition process, the customer is preferably shown on local computer display 55 a graphical image of the message-blanket. package to be physically created according to the plurality of parameters contained in the database. FIG. 10A depicts a simplified illustration of front panel image 230 of the Christmas tree message selected, and FIG. 10B depicts back panel image 235 thereof. It should be clear that greeting 255, "Merry Christmas to You," is depicted on front panel 230 simultaneously with lyric 422, "Wish You a Merry Xmas" incorporated into music device 232 attached to back side of front panel 230. FIG. 10C illustrates an example of a corresponding message-blanket package having an opening at one end thereof adapted for receiving a plurality of customer-selected tangible items. It will be appreciated that, once these items are inserted in the package, the package is sealed in a manner well known in the art. This routine sealing process may include stitching, wax, gluing, fastening, shrink-wrapping, etc.

Figure 11C:
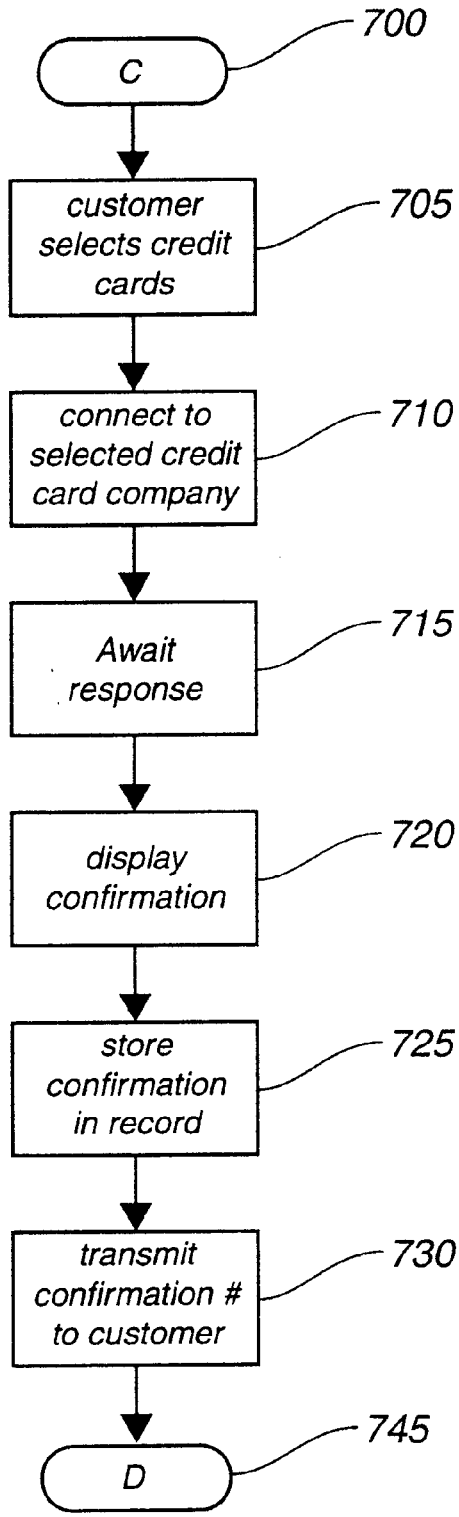

After the customer confirms that the displayed package has been correctly configured, the customization software proceeds to query the customer for appropriate method of delivery to the recipient or recipients. Referring now to FIG. 11C, there is illustrated user-selection of a delivery method. At step 762, the delivery method selection Web page is downloaded to the customer's monitor 55. Then, at step 763, the customer enters recipient postage information; the customer selects either United Parcel Service at step 770, Federal Express at step 780, first class mail at step 790, or Express Mail at step 795. This delivery data is then encoded into an identification code means or other parametric means for storage into customer database 176.

Figure 11D:
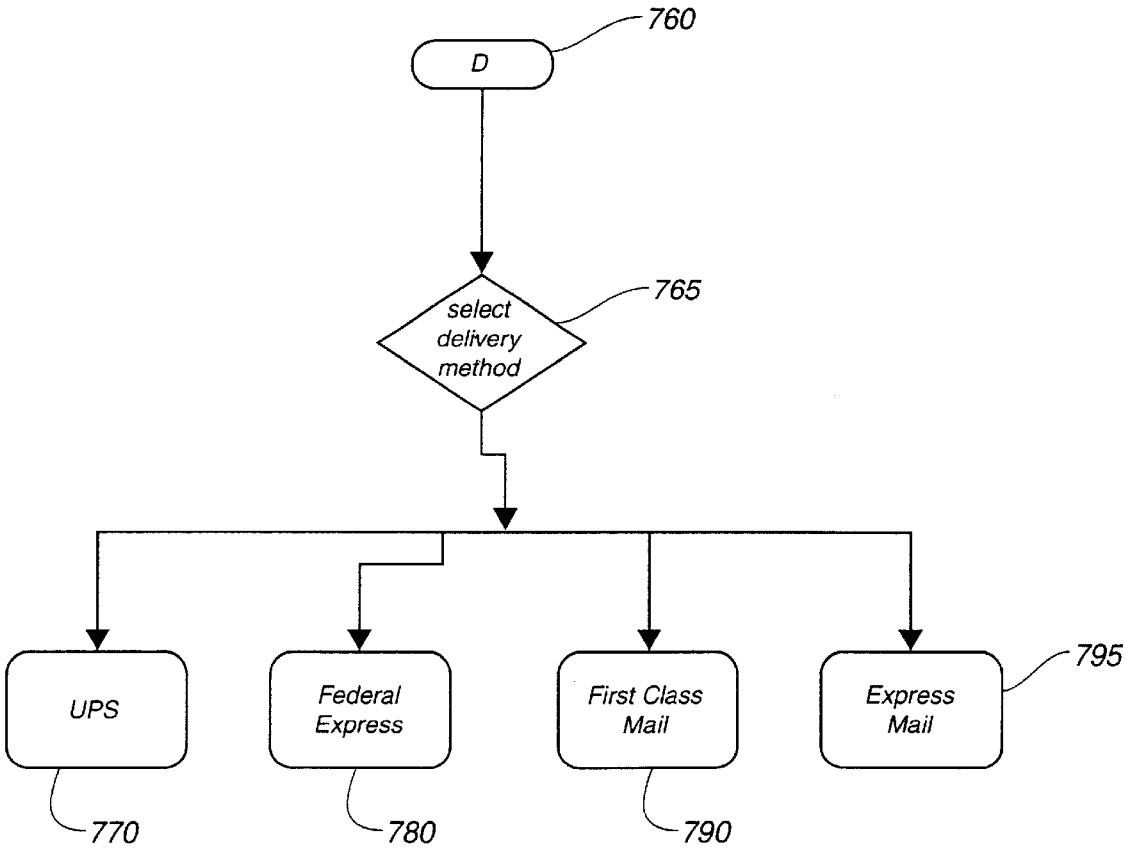
Figure 11E:
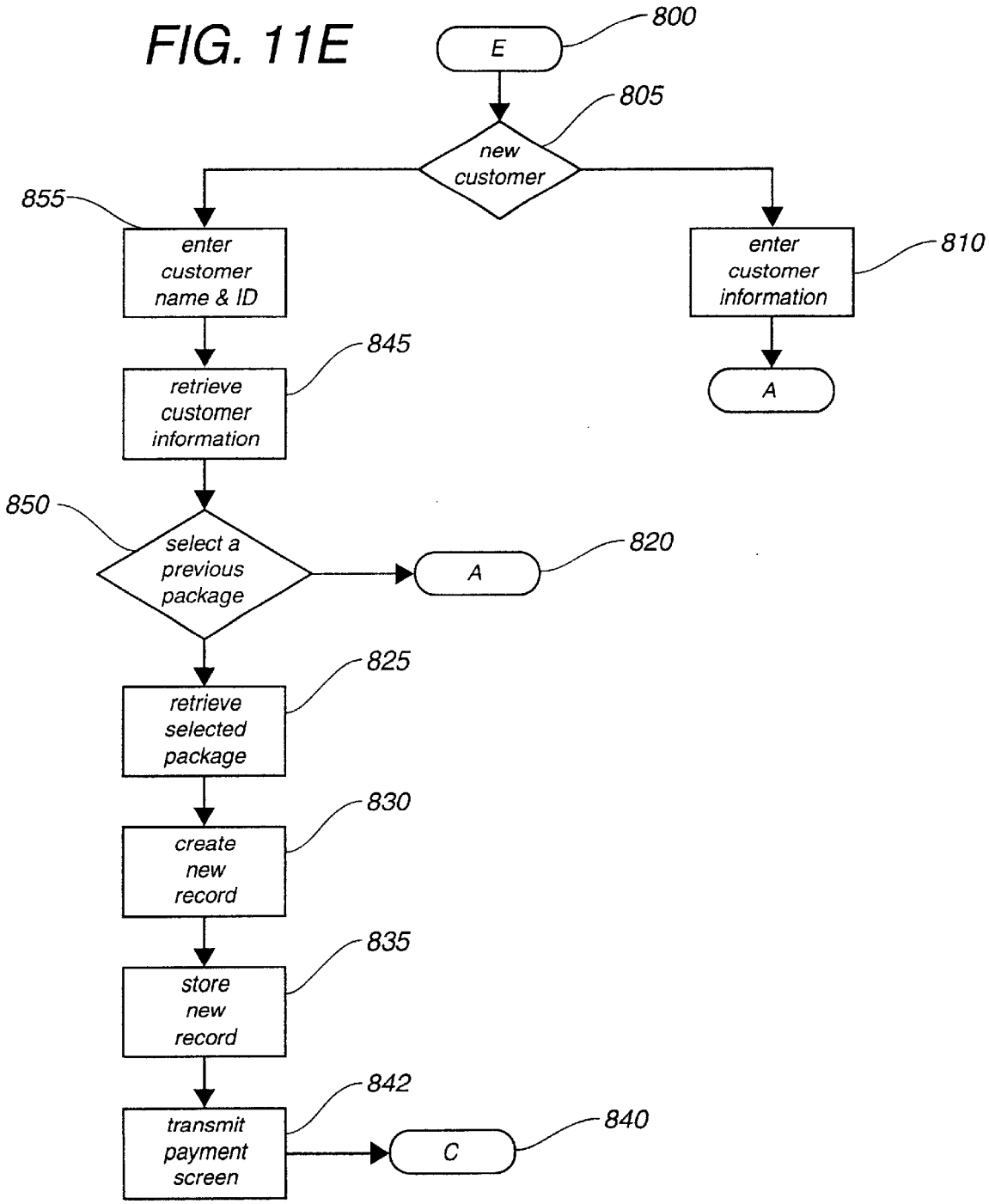

Generally, prior to the actual construction of the plurality of physical embodiments of the message-blanket package specified as hereinbefore described, establishing a payment arrangement is required. Referring to FIG. 11D, there is illustrated the payment authorization process in accordance with the preferred embodiment of the present invention. In step 705, the customer is prompted to enter pertinent credit card information. After the credit card information has been entered and uploaded to the file-server, at step 710, credit card validation is sought by establishing communication with a suitable financial institution. Once the system receives payment authorization from such financial institution, at step 720, confirmation is made with the customer.

Contemporaneously with establishing and confirming customer payment logistics, the plurality of identification codes and parameters representing the configuration and contents of the specified message-blanket package are incorporated into the database of the present invention. Thus, referring to FIG. 12C, there is illustrated the plurality of attributes representing the customer information and corresponding message-blanket package configuration data. In particular, at step 735, database records are composed by associating the codes and parameters created during the message-blanket customization process with each attribute being listed in FIG. 12C. After the association of these attributes, the plurality of database records are stored in customer database 176.

Figure 11F:
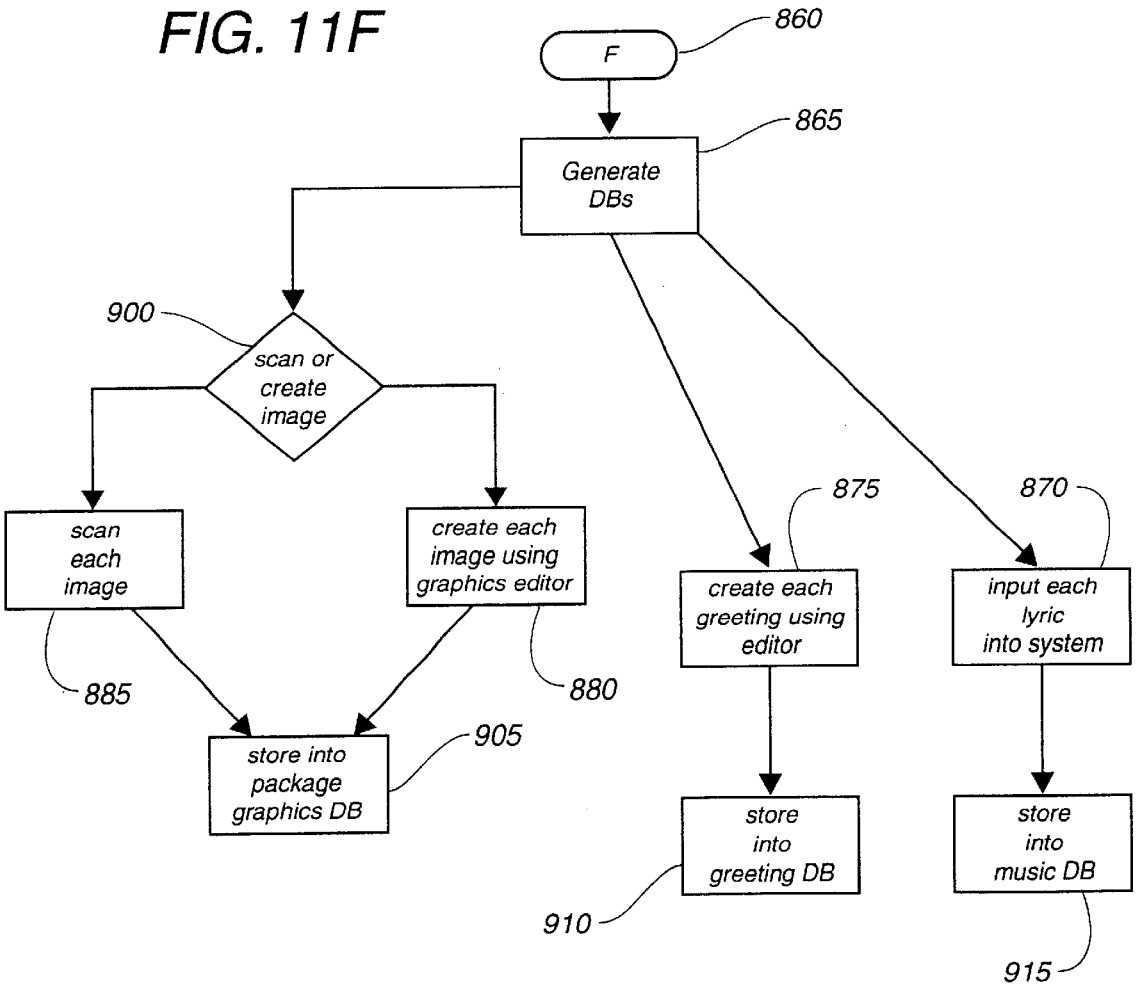

An aspect of the present invention is that, in order to afford the capability of generating a diversity of message-blanket packages to satisfy customers having diverse commercial and personal interests and objectives, customization databases 172 should preferably be adequately populated with a plurality of multimedia components or building blocks, including graphics, clipart, pictorial images, video clips, text, sound clips, and music excerpts to support the occasion menus and related menus. FIG. 11F depicts a simplified flow chart illustrating the process of populating customization databases 172 with a plurality of graphical images, text, and music excerpts. In step 885, using scanner 74, each image is loaded onto hard drive 160 of host server 10 or the like. Then, preferably invoking graphics image compression techniques, each scanned is prepared for storage into graphics image database 175, step 905. As is well known in the art, another method of loading such multimedia information into customization databases 172 is use of image editing or sound editing software. Thus, as shown, using special editors in steps 880, 875, and 870, respectively, graphics images, text and music are created and stored in customization databases 172. Alternatively, of course, multimedia files or the like may be downloaded onto hard drive 160 via the Internet or the like, or may be copied onto the hard drive from a CD or other removable storage medium. It should be evident that having a rich selection of multimedia options populating customization databases 172 tend to promote customer satisfaction by enabling a wide variety of message-blanket packages to be custom-designed and produced.

It is another aspect of the present invention that production of a customer-defined message-blanket package is preferably effectuated under the auspices of. construction software 155. It should be apparent to those skilled in the art that, while the manufacture of message-blanketed packages taught herein may be achieved by hand or assembly-line production, use of computers provide a convenient means for monitoring and tracking customer needs and requirements on a broad geographical basis. FIGS. 12A and 12B depict flow charts illustrating the functions of construction software 155 to effectuate message-blanket package construction. Referring specifically to FIG. 12A, file-server 10 transmits to digital computer 105 a logon screen for entry of logon data and security data, e.g., a password, by processor 100. After processor 100's logon and password are validated, execution of construction software 155 is prepared. In particular, in step 945, construction software 155, loaded into RAM 95 for execution of its instructions by CPU 97, the matching customer request records are retrieved from customer database 176. Then, the retrieved attributes, at steps 1030, 1025, and 1020, respectively, are associated with the graphic images, greeting, and lyrics stored in databases 172. At step 1035, uses these associated graphics, greeting, and lyrics, software 155 constructs the predefined message. At steps 1040 and 1045, respectively, the message is physically imprinted or the like on the outer surface of front and back panels of stock to be subsumed into the message-blanket package contemplated by the present invention. It will be understood that this procedure of retrieving a customer request from customer database 176 through manufacturing the corresponding panels for the message-blanket package is repeated for each active record stored in customer database 176. It should be clear to those skilled in the art that an active record simply means a record corresponding to a pending request for creating a plurality of message-blanket packages.

FIG. 13 depicts a block diagram depicting an embodiment of a simplified procedure for manufacturing message-blanket packages. Construction software 155 activates printer 70 to physically imprint Christmas tree message 212 onto the outer surface of front panel 257 and back panel 237 from appropriately selected stock material. It will be appreciated that the stock material contemplated under the present invention for the panels may consist of paper, cloth, leather, plastic, or other synthetic materials such as Kevlar or the like. Selection of this outer-packaging material turns on such factors as cost, expected "abuse" during normal shipping and handling, anticipated weather conditions in the delivery area, nature of items to be contained within the package, and amount of materials to be contained therein. Indeed, if these factors so dictate or if the customer so chooses, it is within the teachings of the present invention to impart a protective covering or coating around the package. Ergo, at block 1070, each manufactured front and back panel is shown as being laminated to promote safe delivery and to assure the longevity of the aesthetics of the message-blanket. To demonstrate the versatility of the message-blanket of the present invention, the selected lyric is depicted as sound chip 1060 incorporated into music device 1082 attached to the inside of front panel 257. After printer 70 circumscribes Christmas tree message 212 onto the outer surface of each panel, front panel 257 is superimposed upon back panel 237. Then, using sealer 1075, except for a small opening, the outer edges of front panel 257 are permanently bonded to the corresponding outer edges of back panel 237. As hereinbefore described, any suitable known means for permanently bonding the corresponding outer edges of the panels may be used, including sewing, crimping, heat sealing, fastening, etc. Once the items are inserted into the package through the allocated opening, the opening is preferably permanently sealed to secure the contents of the message-blanket package.

As hereinbefore described, the preferred embodiment of the message-blanket package comprises a substantially flat front panel superimposed upon a corresponding and congruent substantially flat back panel with the outer edges of the front and back panel permanently bonded together except for an opening to insert a plurality of tangible items. It will be appreciated that, once such items are emplaced within the message-blanket package and sealed therein, a unique pudgy appearance complements a verbal and/or graphical message being blanketed about the outside surface of the package.

Alternatively, the message-blanket package of the present invention could be configured into a three-dimensional shape. In this embodiment, while each of the front and back panels is still substantially flat, each panel is no longer typically congruent to the other. Accordingly, to properly join and seal the front and back surfaces of the package, each panel should preferably be constructed with a plurality of fold lines across their planes and/or complementary flanges along their outer edges. Then, after the customized message is physically imprinted onto the outer surface of the front and back panel, the fold lines on each panel or the like may be configured into the intended three-dimensional shape. Complementary flanges may be used to promote interlocking and permanently bonding of the somewhat differently shaped front and rear surfaces.

Other variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the concept of the present invention is to measured by the scope of the appended claims herein.

What is claimed is:

1. A message-blanket package for delivering to a recipient a plurality of specific, customized messages and a plurality of tangible items, said message-blanket package comprising:

a first cover member having an exterior surface and an interior surface;

a second cover member having an exterior surface and an interior surface, with said second cover member disposed parallel to said first cover member and fixedly attached thereto by securing a peripheral edge member of said first cover member to a corresponding peripheral edge member of said second cover member;

a first portion of said plurality of specific, customized messages disposed substantially completely upon a first plurality of background members, in turn, disposed upon said exterior surface of said first cover member;

said first plurality of background members having a tenor functionally related to the tenor of said first portion of said plurality of specific, customized messages;

a second, remaining portion of said plurality of specific, customized messages disposed substantially completely upon a second plurality of background members, in turn, disposed upon said exterior surface of said second cover member;

said second plurality of background members having a tenor functionally related to the tenor of said second portion of said plurality of specific, customized messages;

said plurality of tangible items contained within a pair of walls formed by said interior surface of said first cover member and by said interior surface of said second cover member; and said plurality of specific, customized messages automatically logically delivered simultaneously with said recipient taking possession of said message-blanket package.

2. The message-blanket package recited in claim 1, wherein said message-blanket package has a pudgy appearance attributable to the presence of said plurality of tangible items enclosed therein by said pair of walls.

3. The message-blanket package recited in claim 1, wherein said first cover member is congruent with said second cover member.

4. The message-blanket package recited in claim 1, wherein said peripheral edge member of said first cover member is continuous.

5. The message-blanket package recited in claim 1, wherein said peripheral edge member of said second cover member is continuous.

6. The message-blanket package recited in claim 1, wherein each of said first and said second cover members is laminated with a protective coating.

7. The message-blanket package recited in claim 1, wherein said plurality of messages includes at least one of text, graphics, clipart, and music.

8. A message-blanket package for delivering to a recipient a plurality of specific, customized messages and a plurality of tangible items, said message-blanket package comprising:

a first cover member having an exterior surface and an interior surface;

a second cover member having an exterior surface and an interior surface, with said second cover member disposed parallel to said first cover member and fixedly attached thereto by securing a continuous peripheral edge member of said first cover member to a corresponding continuous peripheral edge member of said second cover member;

a first portion of said plurality of specific, customized messages disposed substantially completely upon a first plurality of background members, in turn, disposed upon said exterior surface of said first cover member;

said first plurality of background members having a tenor functionally related to the tenor of said first portion of said plurality of specific, customized messages;

a second, remaining portion of said plurality of specific, customized messages disposed substantially completely upon a second plurality of background members, in turn, disposed upon said exterior surface of said second cover member;

said second plurality of background members having a tenor functionally related to the tenor of said second portion of said plurality of specific, customized messages;

said plurality of tangible items being independent of said tenor of said plurality of specific, customized messages and contained within a pair of walls formed by said interior surface of said first cover member and by said interior surface of said second cover member, and causing a pudgy appearance; and said plurality of specific, customized messages automatically logically delivered simultaneously with said recipient taking possession of said message-blanket package.

9. The message-blanket package recited in claim 8, wherein said first cover member is congruent with said second cover member.

10. The message-blanket package recited in claim 8, wherein each of said first and said second cover members is laminated with a protective coating.

* * * * *